US005512915A

United States Patent [19]

Leroux

[11] Patent Number: 5,512,915

[45] Date of Patent: Apr. 30, 1996

[54] PROCESS FOR THE CONTROL OF A MATRIX SCREEN HAVING TWO INDEPENDENT PARTS AND APPARATUS FOR ITS PERFORMANCE

[75] Inventor: Thierry Leroux, Fontaine, France

[73] Assignee: Commissariat a l'Energie Atomique, France

[21] Appl. No.: 328,151

[22] Filed: Oct. 21, 1994

Related U.S. Application Data

[63] Continuation of Ser. No. 28,686, Mar. 8, 1993, abandoned, which is a continuation of Ser. No. 646,703, Jan. 25, 1991, abandoned.

[30] Foreign Application Priority Data

Feb. 6, 1990 [FR] France ..... 90 01346

[51] Int. Cl.[6] ..... G09G 3/20

[52] U.S. Cl. ..... 345/55; 345/98; 345/100; 345/103

[58] Field of Search ..... 345/103, 100, 345/99, 98, 104, 55; 348/790, 792, 793; H04N 3/14

[56] References Cited

U.S. PATENT DOCUMENTS

| | | | |
|---|---|---|---|
| 4,630,122 | 12/1986 | Morokawa | 340/784 |
| 4,679,043 | 7/1987 | Morokawa | 340/784 |
| 4,745,485 | 5/1988 | Iwasaki | 358/236 |
| 4,816,816 | 3/1989 | Usui | 340/784 |
| 4,824,212 | 4/1989 | Taniguchi | 340/784 |
| 4,845,473 | 7/1989 | Matsuhashi et al. | 340/784 |
| 4,875,036 | 10/1989 | Washizuka et al. | 340/805 |
| 4,908,710 | 3/1990 | Wakai | 348/793 |
| 4,985,698 | 1/1991 | Mano et al. | 340/784 |
| 5,049,865 | 9/1991 | Nakamura et al. | 340/784 |

FOREIGN PATENT DOCUMENTS

| | | | |
|---|---|---|---|
| 0195203 | 9/1986 | European Pat. Off. | G06F 3/14 |
| 0206178 | 12/1986 | European Pat. Off. | H04N 3/10 |

*Primary Examiner*—Richard Hjerpe
*Assistant Examiner*—Xiao M. Wu
*Attorney, Agent, or Firm*—Hayes, Soloway, Hennessey, Grossman & Hage

[57] ABSTRACT

Process and apparatus for displaying data, during a frame, on a matrix screen having two parts is disclosed. During the first half of the frame time, successive odd rows of the first part of the screen may be selected simultaneously with successive even rows of the second part of the screen. During the second half of the frame time, successive even rows of the first part of the screen may be selected simultaneously with successive odd rows of the second part of the screen.

10 Claims, 4 Drawing Sheets

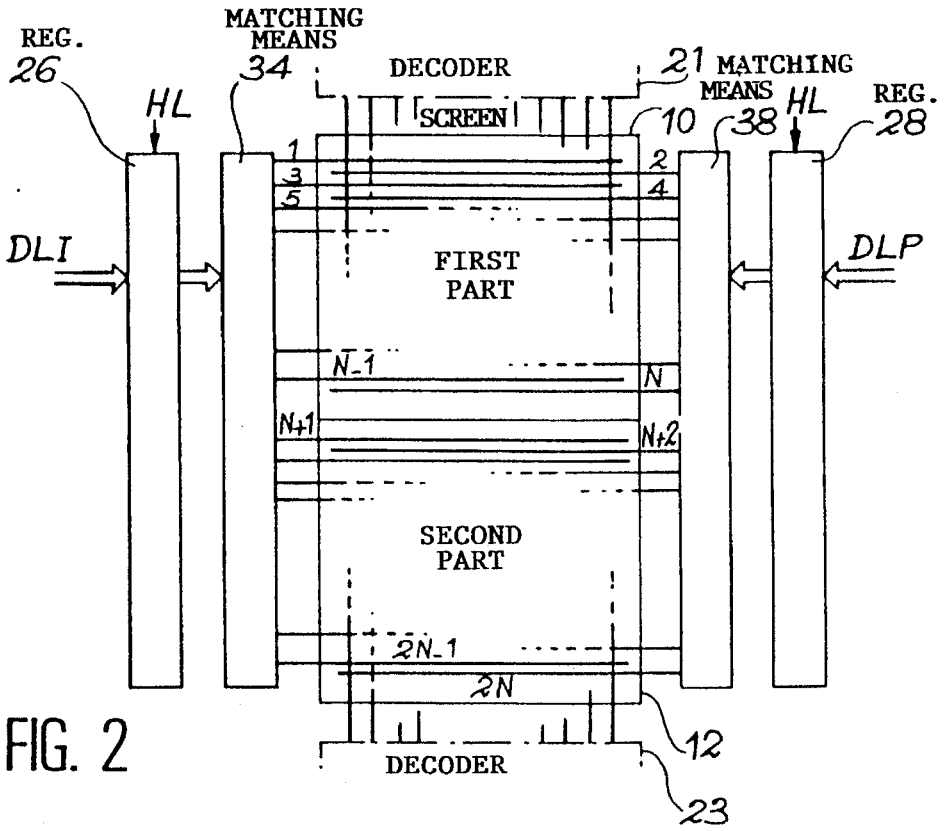
FIG. 2
FIG. 3
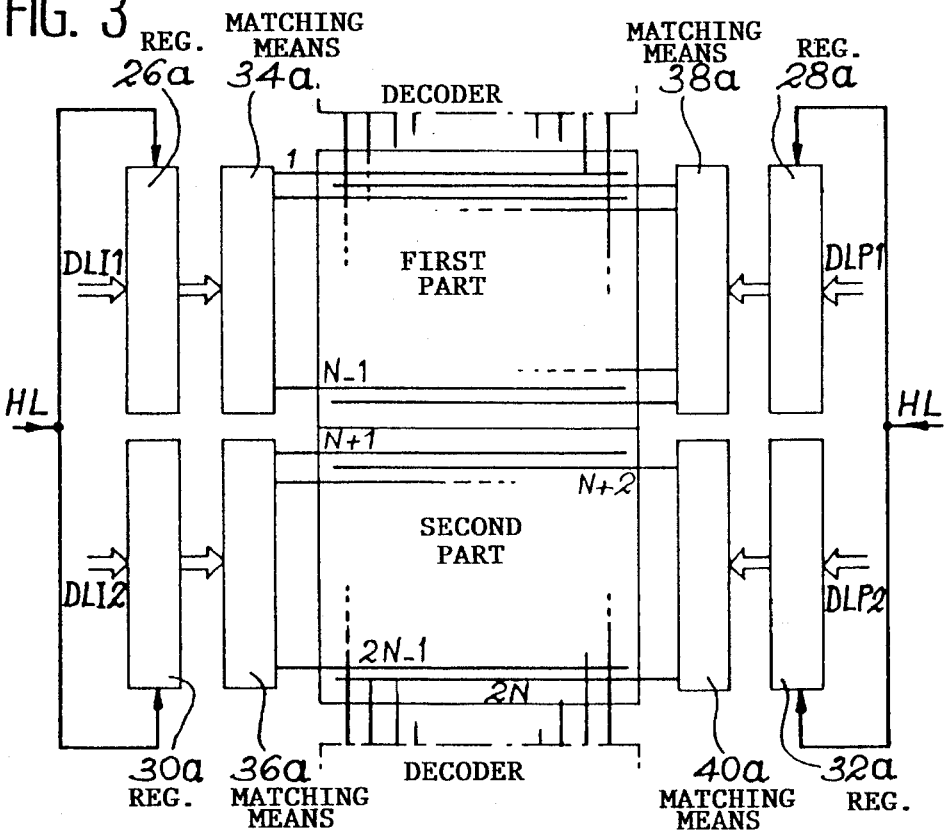

PROCESS FOR THE CONTROL OF A MATRIX SCREEN HAVING TWO INDEPENDENT PARTS AND APPARATUS FOR ITS PERFORMANCE

This is a continuation of application Ser. No. 08/028,686 filed on Mar. 8, 1993, which is a continuation of application Ser. No. 07/646,703 filed on Jan. 25, 1991, now both abandoned.

BACKGROUND OF THE INVENTION

1. Field of the Invention

The present invention relates to a control process for a matrix screen having two independent parts and an apparatus for performing the sane. It more particularly applies to all matrix screens controlled in two independent parts and in particular to video screens (e.g. liquid crystal screens or microdot fluorescent screens).

2. Brief Description of Prior Art

With reference to FIG. 1 a description is given of a prior art matrix screen of this type. Such a screen is constituted by a first part 10 and a second part 12, which are independent bat contiguous. Each part 10, 12 of the screen has N control rows intersecting M addressing columns. For the display, the rows of the first part 10 are successively selected simultaneously with the rows of the second part 12, i.e. row 1 of the first part 10 with row N+1 of the second part 12, row 2 with row N+2 and so on.

The rows are selected by a first register 6 for the first part 10 and a second register 8 for the second part 12. Signals DP for the register 6 and DS for the register 8 supply the data relating to the row to be selected. A row scanning signal HL controls the row selection.

The registers 6 and 8 are respectively connected to amplifying and impedance adapting means 9 and 11 making it possible to apply a given potential to the selected rows.

For each selection of a row of one part simultaneously with a row of the other part, the informations to be displayed are contained in binary coded form in a first and a second registers 14, 16 permitting the addressing of the columns. The first and second registers 14, 16 are connected to decoders 21, 23 permitting the application to the screen columns of potentials corresponding to the informations to be displayed on the pixels of the selected rows. For the duration of said selection, the informations to be displayed during the following selection are recorded in a first end a second buffer registers 18, 20, which are respectively connected to the first and second registers 14, 16 for the transfer of the informations to be displayed.

For a video type signal V supplied by a source 22, the informations to be displayed are supplied in series row by row. Therefore an intermediate memory 24 is required and at a given instant the informations supplied only relate to a single row, whereas two rows are simultaneously displayed and it is also necessary to fill the two buffer registers 18, 20.

Therefore the said memory 24 records the informations to be displayed during their arrival and supplies the buffer registers 18, 20 with the informations necessary for the display. For this purpose it must be able to record the informations to be displayed on all the rows of each screen part 10, 12. It mast therefore have a minimum capacity of 2N M K bits in which 2N is the number of screen rows, M the number of columns and K the number of bits necessary for coding the informations to be displayed on one pixel.

The large capacity of the memory is a serious disadvantage of this known screen, the apparatus costs increasing with the size of the same.

SUMMARY OF THE INVENTION

The present invention aims at reducing the size of the intermediate memory, so as to increase the costs of such a screen.

For this purpose the successive rows of the screen are distributed into successive even end uneven rows, the invention recommending the simultaneous selection of one row of a first parity type of the first part and one row of a second parity type of the second part. Then when all the rows of the first type of the first part and all the rows of the second type of the second part have been selected, simultaneous selection takes place of a row of the second parity type of the first part and a row of the first parity type of the second part so as to select all the rows.

As will be shown in greater detail hereinafter, this control process makes it possible to reduce the memory capacity to N/2M K bits, i.e. it is reduced by a factor of 4 compared with that of the prior art apparatuses.

More specifically, the present invention relates to a control process for a matrix screen constituted by a first part end a second part, each having an even number N of rows, the rows of each of the parts being distributed into rows of a first parity type and rows of a second parity type in successive form, wherein it comprises for each frame of the screen, A) successively selecting the successive rows of the first parity type of the first part, successively selecting the successive rows of the second parity type of the second part, each row of the first type of the first part being selected simultaneously with a row of the second type of the second part with which it is paired;

B) and then successively selecting the successive rows of the second parity type of the first part, successively selecting the successive rows of the first parity type of the second part, each row of the second type of the first part being selected simultaneously with a row of the first type of the second part with which it is paired;

C) for each selected row displaying the informations to be displayed.

The expression rows of a first parity type are understood to mean the uneven rows and rows of a second parity type the even rows or vice versa. In the case where the total number of screen rows is uneven, in order to have two parts with an identical number N of rows, for one of the parts use is made of a fictitious row which is not displayed, but which is taken into account by the screen electronics from the time standpoint. In the sane way when the half of the total number of the rows is uneven, in order to have an even N a fictitious row is added to each part. It is therefore possible to have up to three fictitious rows for a screen.

According to a preferred embodiment of the process, said informations to be displayed are supplied by a source with a regular timing and in an order relative to the successive rows of the screen, wherein D) during their supply, in a memory are recorded the informations to be displayed on the rows of one of the screen parity types, E) parallel to each selection of a row of the first part paired with a row of the second part, each selection starting synchronously with the supply by the source of the informations to be displayed on a row of the other screen parity type, a) in a first memory is recorded from a first buffer register the informations to be displayed on the said selected row of the first part, b) in a second register are recorded from a second buffer register the informations to be displayed on said selected row of the second part, c) the informations supplied by the source and to be displayed on the row of said other parity type of the following selection are recorded in the buffer register associated with the said row, d) the informations to be displayed on the parity row defined in D) of the following selection are transferred from the memory into the buffer register associated with the said row.

The invention also relates to an apparatus for performing the process and comprising for addressing the columns of the screen, a source able to supply on an output the informations to be displayed, a memory able to record the informations to be displayed on the rows of one of the parity types of the screen connected to the output of the source, a means for controlling the writing or reading of the memory connected to the said memory, a means for producing the writing end reading addresses connected to the said memory, a first switching means connected on the one hand to the output of the source and on the other hand to an output of the said memory, a means for controlling the switching of the first switching means connected to the latter, a second switching means connected on the one hand to the output of the source and on the other hand to the output of the said memory, a means for controlling the switching of the second switching means and connected to the latter, a first buffer register connected to an output of the first switching means, a second buffer register connected to an output of the second switching means, a first register connected by its input to an output of the first buffer register and able to supply the informations to be displayed on a selected row of the first part of the screen, a second register connected by its input to an output of the second buffer register and able to supply the informations to be displayed on a selected row of the second part of the screen.

Avantageously, the memory is at least able to simultaneously contain the informations to be displayed on N/2 screen rows.

Thus, during a first frame, the memory records the information relative to the N rows of one of the screen parity types and at the same time it carries out writing operations concerning the informations coming from the source. During the reading operations it transmits informations to one of the buffer registers of the apparatus so that at a given instant the memory only contains N/2. M.K bits relative to the informations of N/2 rows.

According to a particular embodiment, the writing and reading control means of the memory is formed by a counter having two binary states having a counting input able to receive a pulse signal for synchronizing the supply of the informations to be displayed on one row and a second input able to receive a resetting signal, said counter supplying on an output a pulse for each passage to its initial state and on mother output connected to the memory a control signal L/E.

Advantageously, in this embodiment, the means for producing the writing and reading addresses is constituted by a counter with N/2 binary states having a counting input connected to the output of the counter having two binary states supplying pulses on each passage to its initial state and a second input able to receive a resetting signal, said counter supplying on one output a pulse for each passage to its initial state and on mother output connected to the memory an signal AD.

According to a preferred embodiment, the first and second means for controlling the snitching of the first and second stitching means are constituted by a single circuit.

Advantageously, the said single circuit is a counter having two binary states with a counting input connected to the output of the counter with N/2 binary states supplying on one output a pulse for each passage to its initial state and a second input able to receive a resetting signal, said counter supplying to an output connected to the first and second stitching means a control signal HB.

According to an advantageous embodiment for selecting the screen rows, the apparatus comprises at least one register having a first input able to receive a clock signal and a second input able to receive a data signal.

According to a special embodiment, the apparatus comprises a first register with N stages for the selection of N rows of the first parity type of the first and second parts of the screen and having a first input able to receive a clock signal and a second input able to receive a first data signal (DLI) and a second register having N stages for the selection of N rows of the second parity type of the first and second parts of the screen and having a first input able to receive the clock signal and a second input able to receive a second data signal (DLP).

BRIEF DESCRIPTION OF THE DRAWINGS

The invention is described in greater detail hereinafter relative to non-limiting embodiments and the attached drawings, wherein there exists:

FIG. 2 Diagrammatically a circuit for selecting the rows of a screen according to the invention.

FIG. 3 Diagrammatically a variant of the selection circuit according to the invention.

DETAILED DESCRIPTION OF PREFERRED EMBODIMENTS

Figure 1:
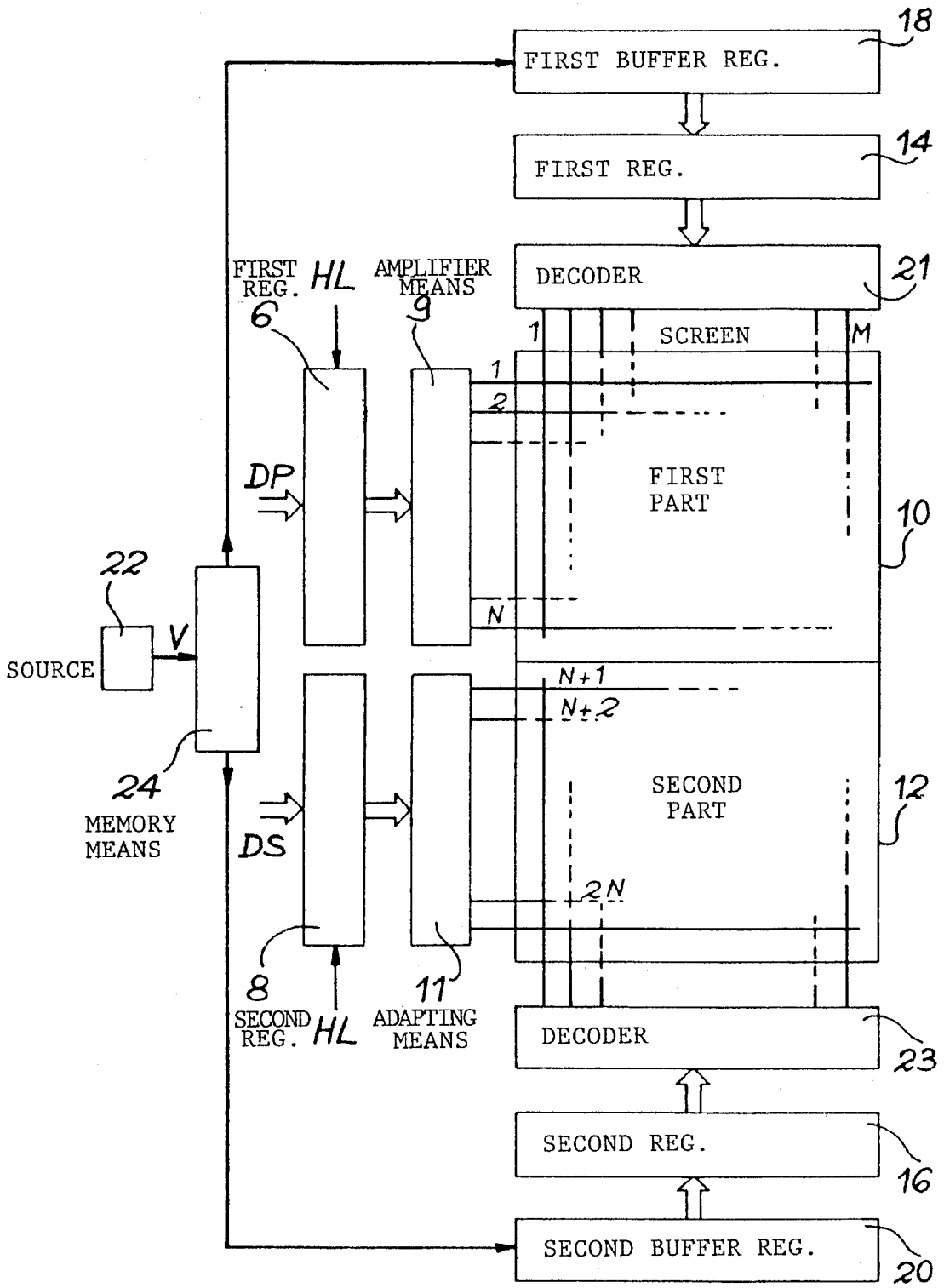
FIG. 1 PRIOR ART
FIG. 1, already described and relating to the prior art, diagrammatically a two-part matrix screen.

FIGS. 2, 3, 4 and 6 diagrammatically show variants of a circuit for the selection of a matrix screen having two parts 10, 12, which are independent, but contiguous so as to ensure the continuity of the rows and the columns. The screen can be of the microdot fluorescent or liquid crystal type.

Each part 10, 12 has an even number N of rows and for the first part 10 the said rows are numbered 1 to N and for the second part 12 N+1 to 2N. The screen rows are consequently subdivided into successive even and uneven rows.

Each part of the screen also has M columns. The screen pixels are formed at each intersection of rows end columns.

According to the invention during a first half of the frame time, each row of a first parity type of the first screen part 10 is simultaneously selected with a row of a second parity type of the second part 12. During a second half of the screen time, each row of the second parity type of the first part 10 is selected simultaneously with a row of the first parity type of the second part 12.

For reasons of clarity hereinafter the first parity type will be assumed to be the uneven parity and the second parity type the even parity.

FIG. 2 diagrammatically shows a matrix screen having two contiguous parts 10, 12 provided with a row selection circuit according to the invention. The selection circuit comprises two registers 26, 28 having N stages respectively supplied by data signals DLI, DLP relating to the uneven and even rows to be selected and supplied by a not shown control circuit. The register 26 is connected to amplifying and impedance matching means 34, themselves connected to the uneven rows of the first part 10 and the second part 12.

The register 28 is connected to amplifying and impedance matching means 38, themselves connected to the even rows of the first part 10 and the second part 12.

During one screen frame all the screen rows are selected once.

At the start of each frame, the signals DLI, DLP, respectively applied to the registers 26, 28 indicate the rows to be selected during the first selection. Thus, for example, if the rows to be selected at the start of the frame are rows 1 and N+2, the signals DLI end DLP respectively corresponding to the bits, whereof only the first bit is non-zero for DLI end whereof only the N/2+1 bit corresponding to the row N+2 is non-zero for DLP. The following selections are obtained by shifting the signals contained in the registers by applying clock pulses HL to the inputs of the registers 26 and 28.

During the first half of a screen frame, the register 26 successively selects the uneven rows of the first part 10. Simultaneously the register 28 successively selects the even rows of the second part 12.

In this way each uneven row of the first part 10 is selected simultaneously with the selection of an even row of the second part 12 with which it is paired. For example, the row numbered 1 is selected simultaneously with the row numbered N+2 and so on up to the final uneven row numbered N−1 of the first part 10 selected simultaneously with the row numbered 2N of the second part 12.

During the second half of a frame, the register 28 successively selects the even rows of the first part 10. Simultaneously, the register 26 successively selects the uneven rows of the second part 12.

Thus, each even row of the first part 10 is selected simultaneously with that of an uneven row of the second part with which it is paired. For example, the row numbered 2 is selected simultaneously with the row numbered N+1 and so on up to the final even row of the first part 10 numbered N and selected simultaneously with the row numbered 2N−1 of the second part 12.

FIG. 3 diagrammatically shows a variant of a selection circuit. This variant makes it possible to select successive uneven or even rows of the first part 10 simultaneously with the successive even or uneven rows of the second part 12 with which they are paired.

The selection circuit also comprises four registers 26*a*, 28*a*, 30*a*, 32*a* with N/2 stages connected, as hereinbefore, to amplifying and impedance matching means 34*a*, 38*a*, 36*a*, 40*a*. The four registers are not interconnected, but an identical clock signal HL applied to an input of each of the registers controls the selection of a row.

Moreover, following each half-frame, control signals DLI1, DLP1, DLI2, DLP2 supplied by a not shown control circuit are respectively applied to the registers 26*a*, 28*a*, 30*a*, 32*a*. As in the case of FIG. 2, these data signals introduce into the stages of the corresponding registers signals corresponding to bits, whereof only the stage corresponding to a row to be selected contains a non-zero bit. During each half-frame, the signals contained in the registers undergo a shift for each clock pulse, so as to select the rows which are to be selected.

During a first half-frame, the registers 26*a* and 32*a* (containing a non-zero bit), each select a row, whereas the registers 28*a* and 30*a* (only containing zero bits) make no selection, the situation being reversed during the following half-frame.

Figure 4:
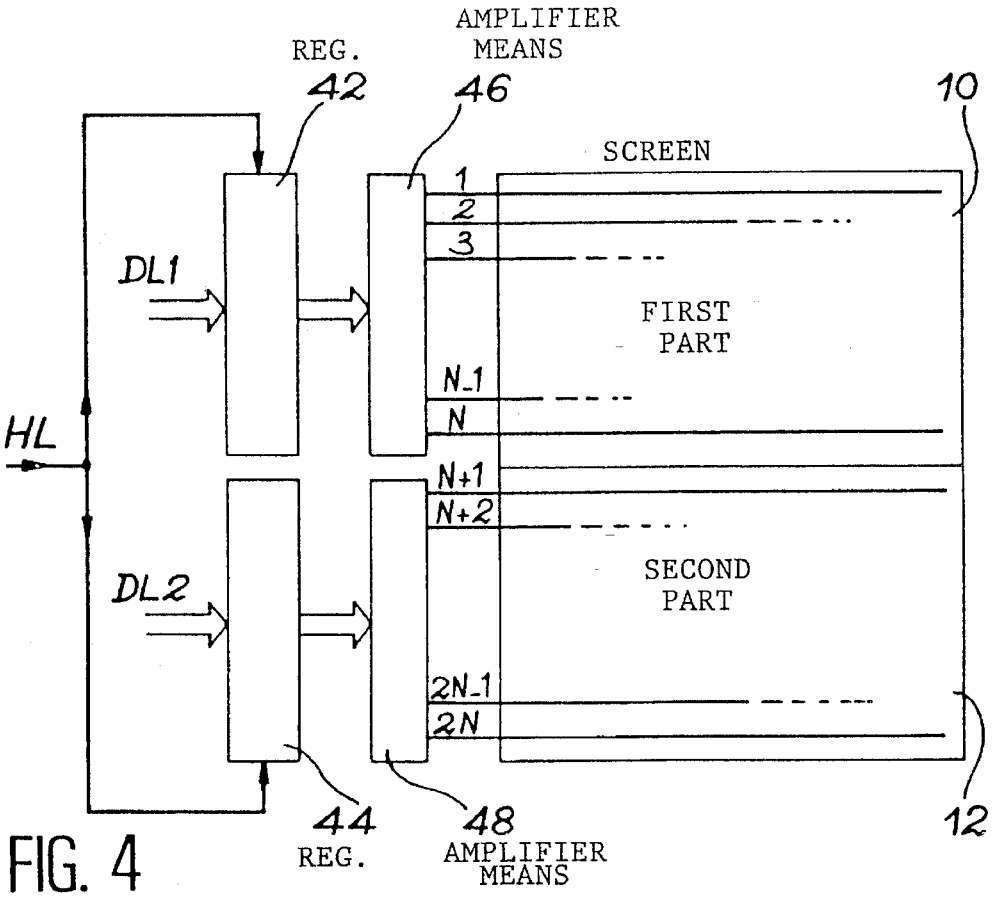
FIG. 4 Diagrammatically another variant of a selection circuit according to the invention.

FIG. 4 diagrammatically shows another variant of a selection circuit according to the invention. It is constituted by two registers 42, 44 having N stages respectively connected to amplifying and impedance matching means 46, 48.

The amplifying and impedance matching means 46 is connected to the rows of the first part 10, whilst the amplifying and impedance matching means 48 is connected to the rows of the second part 12.

Data signals DL1 and DL2 supplied by a not shown control circuit make it possible to select the rows of each part.

Clock pulses HL supplied to the inputs of the registers 42, 44 control the shifts of informations contained in the registers 42, 44 and therefore each new selection of a pair of rows. This type of selection circuit requires clock pulses having an asymmetrical timing diagram.

Thus, the stages of the registers supplied by the signals DL1 and DL2 make it possible, during a first half of the duration of a frame, to simultaneously select an uneven row of the first part 10 and an even row of the second part 12. During the second half of the duration of a frame, they permit the simultaneous selection of an even row of the first part 10 and an uneven row of the second part 12. During each half-frame the rows which are not to be displayed are selected during a time which is too short to be effective.

Figure 5A:
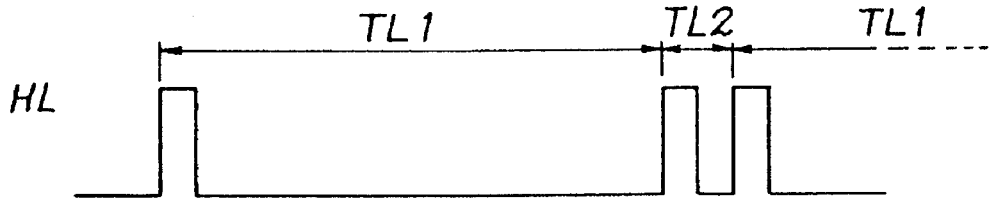
FIGS. 5A Diagrammatically clock signals for the selection of the rows and 5B in the case of the circuit of FIG. 4.

FIG. 5A shows the timing diagram of the clock pulses HL for the selection of the uneven rows of the first part 10 and the even rows of the second part used during the first half of a frame time. Two different periods TL1 and TL2 are used for the selection of the uneven and even rows of the first part 10 (and the even and uneven rows with which they are paired).

The duration of a period TL1 separating two clock pulses during the selection of an uneven row of the first part 10 (or an even row of the second part) is substantially equal to the usual row selection time. However, the duration of a period TL2 separating two clock pulses during the selection of an even row of the first part (or an uneven row of the second part) is well below the usual row selection time. In this way, even rows of the first part 10 and uneven rows of the second part 12 are selected during a time which is too short for a display to be initiated on the said rows.

Figure 5B:
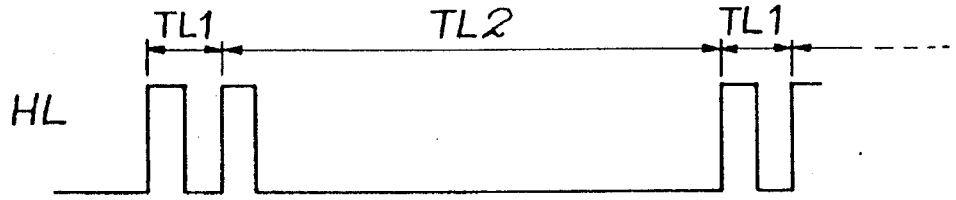

FIG. 5B is the timing diagram of the clock pulses HL for the selection of the even rows of the first part 10 and the paired uneven rows of the second part 12 used during the second half of a frame time. In the said timing diagram, TL1 has a duration well below the normal row selection duration, whereas TL2 has a duration substantially equal to the normal row selection duration. Therefore the selection of rows which are not to be displayed only takes place during a time which is too short for a display to be initiated and consequently their selection has no consequence.

Figure 6:
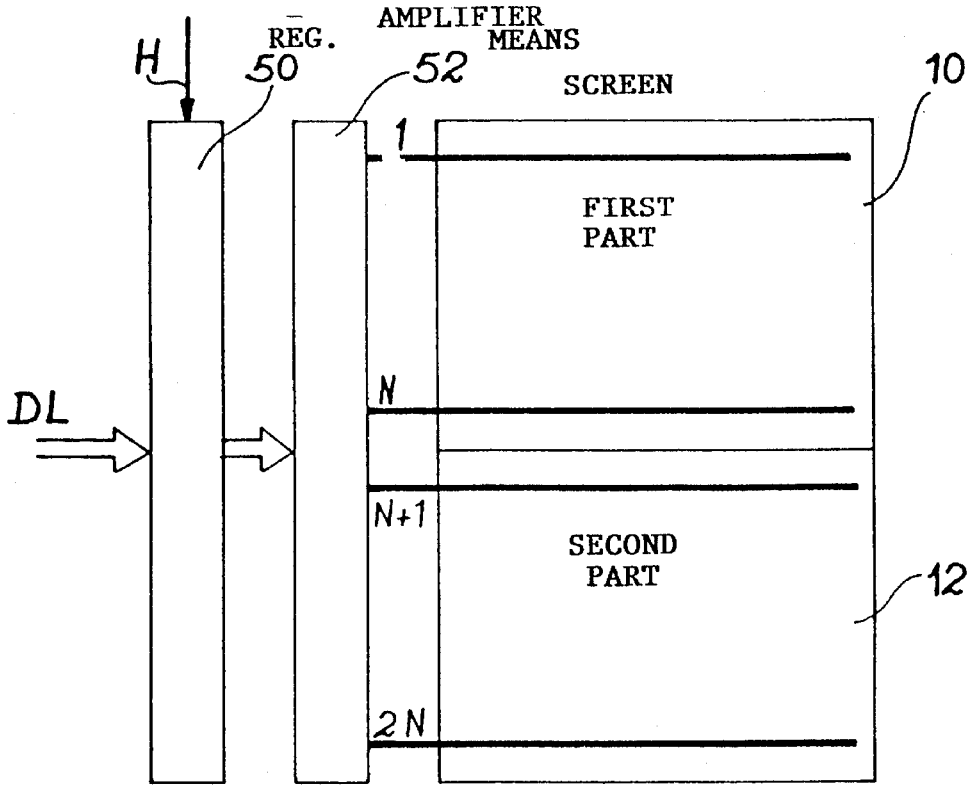
FIG. 6 Diagrammatically another variant of a selection circuit according to the invention.

FIG. 6 shows another variant of a row selection circuit according to the invention. This circuit only uses a register 50 with two N stages connected to an emplifying and impedance matching means 52, which is itself connected to the rows of the two screen parts 10, 12.

Data signals DL supplied by a not shown control circuit and programmed for this purpose permit the selection of the rows which are to be selected. The signals DL correspond to all the signals DL1 and DL2 of FIG. 4. Therefore the register 50 contains two non-zero bits.

The clock pulses H supplied on an input of the register have an asymmetrical timing diagram identical to those of FIGS. 5A and 5B. The pulses corresponding to the timing diagram of FIG. 5A are applied during a first half-frame and the pulses corresponding to the timing diagram of FIG. 5B during the following half-frame.

Figure 7:
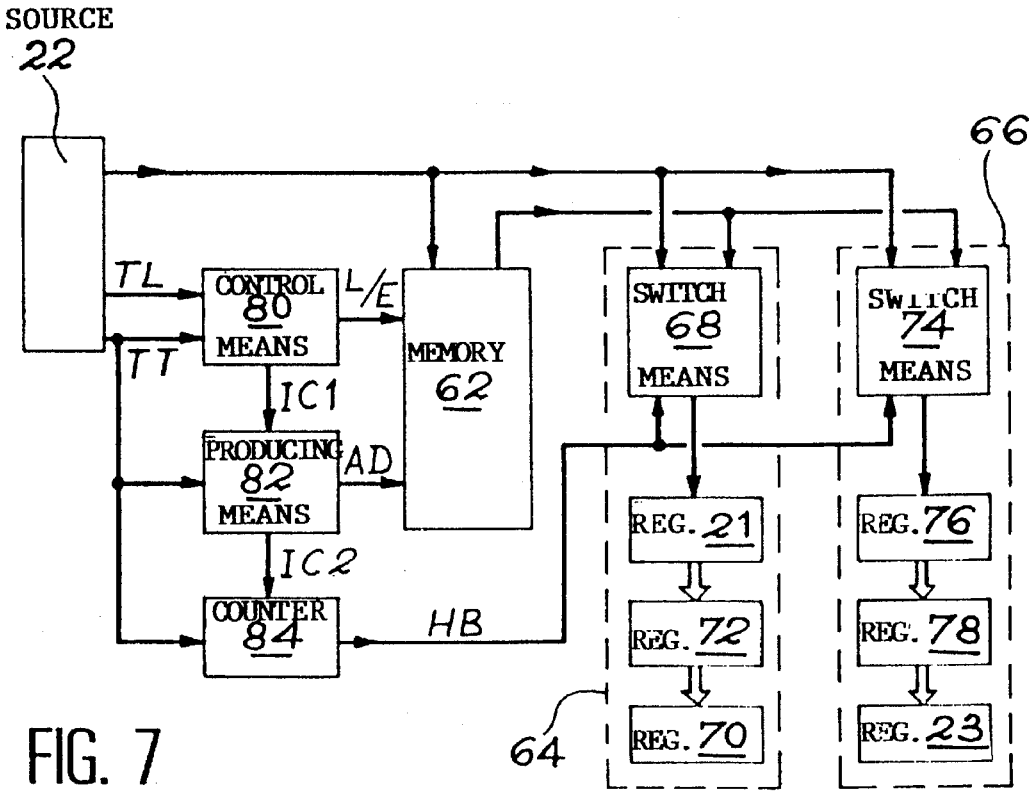
FIG. 7 Diagrammatically a circuit for addressing columns of a screen according to the invention.

FIG. 7 diagrammatically shows a circuit for addressing the columns of the screen according to the invention. With a regular timing, a source 22 supplies binary coded informations in an order relative to the successive screen rows. This source also supplies clock pulses TL synchronized with the supply of the informations to be displayed on one row of the screen end frame informations TT. Each information to be displayed on a screen pixel is binary coded by a number of K bits.

The output of the source supplying the informations to be displayed is connected to an input of a memory 62 having a capacity at least able to simultaneously contain the informations to be displayed on N/2 rows of the screen, to an input of a circuit 64 for addressing the columns of the first screen part and to an input of a circuit 66 for addressing the columns of the second screen part. For example, the memory 62 has a capacity for storing about one-fourth of the data displayed on the matrix screen during a frame.

The circuit 64 comprises a switching means 68 of the nultiplexer type connected on the one hand to the source 22 and on the other to an output of the memory 62, a buffer register 70 connected to an output of the switching means 68, a register 72 connected to an output of the buffer register 70 end a decoder 21 connected by an input to the register 72 and by an output to the columns of the first screen part 10.

The circuit 66 comprises and connected in a manner identical to the preceding circuit, a switching means 74 of the multiplexer type, a buffer register 76, a register 78 and a decoder 23 connected to the columns of the second screen part 12.

The decoders 21 and 23 carry out a matching between the informations in binary form contained in the registers 72, 78 and the informations to be applied to the columns.

The addressing circuit also has a memory writing and reading control means 80 and supplying on an output connected to one input of the memory 62 a writing or reading signal L/E.

Said means 80 can be in the form of a counter having two binary states having a first and a second data inputs connected to the outputs of the source 22 supplying clock pulses and frame pulses, the latter carrying out a resetting of the counter 80.

As from the resetting and following a first clock pulse TL, the counter e.g. supplies a reading signal to memory 62 and following the second clock pulse the counter supplies a writing signal to memory 62. The counter functions in this way for the successive clock pulses until resetting occurs during a frame pulse.

Thus, during their supply by the source 22, the informations to be displayed on the screen rows are recorded on every other occasion in the memory 62. In addition, the memory only records the informations relative to the rows of a single parity type. For example, throughout the remainder of the description it will be assumed that the memory only records the informations to be displayed on the even rows of the screen.

Moreover, for each reading pulse supplied by the counter to the memory, the latter transmits informations relative to a selected even row to the switching means 68 or 74, as a function of whether the selected row is included in screen part 10 or 12.

In addition, said counter 80 supplies pulses IC1 to an output whenever it reassumes its initial state, i.e. every other clock pulse.

The addressing circuit also has a means 82 for producing writing and reading addresses connected by an output to an input of the memory 62. Said means 82 can be constituted by a counter with N/2 binary states having a counting input connected to an output of the counter 80 with two binary states for the reception of the pulses IC1. It also has a second input connected to the output of the source 22 supplying the frame pulses permitting a resetting of the counter 82.

The means 82 supplies the memory with a signal AD designating the addresses for writing and reading into the memory 62. Each address is formed by a word having L bits with L an integer and respecting the condition:

$$(\text{Log } N/2)/\text{Log}2, \leqq L \leqq 1+(\text{Log } N/2)/\text{Log}2.$$

For each pulse IC1, the signal AD designates a particular address common to the reading of a row of one of the screen parts and to the writing of a row of the other screen part. Thus, for example, for a screen having even rows 2, 4, . . . N for part 10 and even rows N+2, N+4, . . . 2N for part 12, the reading and writing addresses of these rows respectively correspond to binary coded 1, 2, . . . N/2. As each address AD is maintained during a reading pulse and a writing pulse, the information of the corresponding row stored in the memory at address AD is read and then replaced by an information corresponding to a row of the other screen part. These two rows are of the sane order in each part, i.e. 2 and N+2 or N+2 and 2, 4 and N+4 or N+4 and 4 . . . N and 2N or 2N and N.

In addition, whenever it reassumes its initial state, i.e. every N clock pulses, the counter with N/2 binary states supplies a pulse IC2 to an output.

Finally, the addressing circuit has means for the control of the switching operations of the switching means 68, 74. These means are constituted by a counter 84 having two binary states. This counter 84 has a counting input connected to an output of the counter with N/2 binary states for the reception of the pulses IC2. It also has a second input connected to the output of the source 22 supplying frame pulses, which initiate its resetting.

The counter 84 supplies a signal HB, whose binary value determines whether the multiplexers 68 and 74 supply the buffer registers 70 and 76 with informations coming directly from the source 22 and relating to the uneven rows or coming from the memory 62 and relating to the even rows.

Whenever N/2 pulses IC1 have been counted by the counter 82, i.e. when N clock pulses have been supplied by the source 22, the counter 84 changes state under the action of the pulse IC2 supplied by the counter 82.

For example, for a binary value of the signal HB equal to "0", i.e. during the first half of the frame time, the multiplexer 68 supplies on its output the informations from the source 22, whilst the multiplexer 74 supplies on its output the informations from the memory 62.

For a binary value of the signal HB equal to "1", i.e. during the second half of the frame time, the multiplexer 68 supplies to its output the informations from the registered memory 62, whilst the nultiplexer 74 supplies to its output the informations from the source 22.

The selection by the selection circuit of the rows to be displayed starts synchronously with the supply by the source 22 of the informations to be displayed on an uneven row of the screen. This synchronisn is obtained through the clock pulse TL and frame pulse which are or are not transformed in order to form the clock pulses initiating the register or registers of the selection circuit. During their supply by the source 22, the informations to be displayed on the even rows of the screen are recorded in the memory 62.

For each selection of a pair of rows, the registers 72, 78 record the informations respectively contained in the buffer register 70, 76. These informations decoded by the decoders 21, 23 are displayed on the selected rows of the first and second screen parts.

The buffer registers 70, 76 then record the informations to be displayed during the following selection. These informations come either directly from the source 22 or the memory 62 via multiplexers 68, 74 controlled by the signal HB. Thus, there is constantly a shift between the supply of the informations by the source 22 and their display. This shift is equal to a half-frame time for the informations to be displayed on an even line, whereas it is only equal to a row selection time for the informations to be displayed on an uneven row.

On switching on the screen, the first frame permits the initialization of the counters and registers and the filling of the memory with the informations to be displayed on half the even rows of the following frame.

The different connections of the source 22 to members 62, 68, 74, of member 62 to members 68, 74, of members 68, 74 to members 70, 76 and member 82 to member 62 are provided by buses.

The process and apparatus according to the invention make it possible to only use a single reduced capacity memory, thereby reducing the costs of two-part screens. Obviously the invention is not limited to the embodiments specifically described and shown end in fact covers all variants thereof.

I claim:

1. A process for displaying data, during a frame, on a matrix screen having a first part and a second part, each said part having an even plurality of rows of number N, each said plurality of rows of each said part being organized into two pluralities of rows, a first plurality having a first parity and a second plurality having a second parity different from said first parity, each said part also having a plurality of independently addressable columns M, each said column of said first part crossing over all of the rows of said first part, each said column of said second part crossing over all of the rows of said second part, individual pixels of said screen being defined by points at which said columns cross over said rows, said frame to be displayed being divided into a first half-frame and second half-frame, said process comprising the steps of:

a. successively selecting, during said first half-frame, successive rows of said first parity of said first part, while simultaneously successively selecting successive rows of said second parity of said second part that are paired with said successive rows of said first parity of said first part;

b. successively selecting, during said second half-frame successive rows of said second parity of said first part, while simultaneously successively selecting successive rows of said first parity of said second part that are paired with said successive rows of said second parity of said first part; and c. displaying on rows selected during steps a and b, data supplied from a memory means and a video source with a regular timing and in an order related to successive rows of the screen, selection of said rows taking place at twice said regular timing, wherein during step a, data displayed on the rows of said first parity of said first part are supplied from the source and data displayed on the rows of said second parity of said second part are supplied from said memory means, and wherein during step b, data displayed on the rows of said second parity of said first part are supplied from said memory means and data displayed on the rows of said first parity of said second part are supplied from the source, the data supplied from said memory means during said first half-frame having been supplied from said source and stored in said memory means during a preceding half-frame, and the data supplied from said memory means during said second half-frame having been supplied from said source and stored in said memory means during said first half-frame, said memory means having a capacity for storing about one-fourth of the data displayed on said matrix screen during said frame.

2. A process according to claim 1, wherein:

i. during the supply of said data in a memory are recorded the data to be displayed on the rows of the second parity;

ii. parallel to each selection of a row of the first part paired with a row of the second part, each selection starting synchronously with the supply by the source of the data to be displayed on a row of the first parity, a. in a first register is recorded from a first buffer register the data to be displayed on said selected row of the first part, b. in a second register are recorded from a second buffer register the data to be displayed on said selected row of the second part, c. the data supplied by the source and to be displayed on the row of said first parity of the following selection are recorded in the buffer register associated with said row, d. the data to be displayed on the second parity row of the following selection are transferred from the memory into the buffer register associated with said row.

3. Apparatus for displaying data, during a frame, on a matrix screen having a first part and a second part, each said part having an even plurality of rows of number N and a plurality of independently addressable columns M, each said plurality of rows of each part being organized into two pluralities of rows, a first plurality having a first parity and a second plurality having a second parity different from said first parity, said frame to be displayed being divided into a first half-frame and a second half-frame, said apparatus being capable of performing the process of claim 1, and comprising, a source for supplying on an output the data to be displayed, a memory for recording alternatively the data to be displayed on the rows of the second parity of each part of the screen and being connected to the output of the source, means for controlling the writing and reading of the memory and connected to said memory, means for generating the writing and reading addresses and connected to said memory, first switching means connected both to the output of the source and to an output of said memory, means for controlling the switching of the first switching means and connected to said first switching means, second switching means connected to both the output of the source and to the output of said memory, means for controlling the switching of the second switching means and connected to the latter, a first buffer register connected to an output of the first switching means, a second buffer register connected to an output of the second switching means, and a first register connected to an output of the first buffer register for supplying the data to be displayed on a select of the first part of the screen, a second register connected to data output of the second buffer register for supplying the data to be displayed on a selected row of the second part of the screen simultaneously with the display of said data on said first part, and wherein each said column of said first part crosses over all of the rows of said first part, each said column of said second part crosses over all of the rows of said second part, and individual pixels of said screen are defined by points at which said columns cross over said rows.

4. Apparatus according to claim 3, wherein the memory has sufficient storage to simultaneously contain the data to be displayed on N/2 screen rows.

5. Apparatus according to claim 4, wherein the writing and reading control means of the memory comprises a counter having two binary states having counting input for receiving a pulse signal synchronized with the supply of the data to be displayed on a row and a second input for receiving a resetting signal, said counter supplying on one output a pulse for each transition to its initial state and on another output connected to the memory a control signal.

6. Apparatus according to claim 5, wherein the means for producing writing and reading addresses comprises a counter with N/2 binary states having a counting input connected to the output of the counter with two binary states supplying pulses upon each transition to its initial state and a second input for receiving a resetting signal, said counter supplying on one output a pulse upon each transition to its initial state and on another output connected to the memory an address signal.

7. Apparatus according to claim 6, wherein the first and second means for controlling the switching of the first and second switching means comprise a single circuit.

8. Apparatus according to claim 7, wherein said single circuit is a counter having two binary states with a counting input connected to the output of the counter with N/2 binary states and supplying on an output a pulse upon each transition to its initial state and a second input for receiving a resetting signal, said counter supplying to an output connected to the first and second switching means a control signal.

9. Apparatus according to claim 3, and further comprising, for selecting the screen rows, at least one register having a first input for receiving a clock signal and a second input for receiving a data signal.

10. Apparatus according to claim 9, and further comprising a first register with N stages for the selection of N rows of the first parity of the first and second parts of the screen and having a first input for receiving a clock signal and a second input for receiving a first data signal and second register having N stages for the selection of N rows of the second parity of the first and second parts of the screen and having a first input for receiving the clock signal and second input for receiving a second data signal.

* * * * *

UNITED STATES PATENT AND TRADEMARK OFFICE

CERTIFICATE OF CORRECTION

PATENT NO. : 5,512,915

DATED : April 30, 1996

INVENTOR(S) : Thierry Leroux

It is certified that error appears in the above-indentified patent and that said Letters Patent is hereby corrected as shown below:

Claim 3, Col.11, Line 28, "select of" should be - -selected row of- -.

Signed and Sealed this

First Day of October, 1996

*Attest:*

BRUCE LEHMAN

*Attesting Officer*

*Commissioner of Patents and Trademarks*